United States Patent [19]

Sherrod

[11] 4,228,584

[45] Oct. 21, 1980

[54] METHOD OF ELECTRICAL CONNECTOR

[75] Inventor: C. David Sherrod, Knoxville, Tenn.

[73] Assignee: Carrier Corporation, Syracuse, N.Y.

[21] Appl. No.: 944,947

[22] Filed: Sep. 22, 1978

Related U.S. Application Data

[62] Division of Ser. No. 863,481, Dec. 22, 1977, abandoned.

[51] Int. Cl.[3] ..... H01R 43/04

[52] U.S. Cl. ..... 29/863; 85/9 R

[58] Field of Search ..... 29/628, 630 A, 630 R, 29/509, 505; 85/9 R

[56] References Cited

U.S. PATENT DOCUMENTS

| | | | |
|---|---|---|---|
| 1,685,382 | 9/1928 | Stuart . | |
| 1,891,521 | 12/1932 | Brackett | 85/9 R |
| 2,572,956 | 10/1951 | Servis | 29/509 X |
| 3,152,507 | 10/1964 | Wieber | 85/9 R |
| 3,416,122 | 12/1968 | Kinkaid . | |
| 3,596,236 | 7/1971 | Shlesinger, Jr. . | |
| 3,696,501 | 10/1972 | Burtin | 29/509 |
| 3,739,323 | 6/1973 | Spors . | |

FOREIGN PATENT DOCUMENTS

| | | | |
|---|---|---|---|
| 323446 | 1/1930 | United Kingdom | 29/509 |

*Primary Examiner*—Francis S. Husar
*Assistant Examiner*—C. J. Arbes
*Attorney, Agent, or Firm*—J. Raymond Curtin; John S. Sensny

[57] ABSTRACT

An electrical connector having a head that includes a bottom and two upstanding, parallel, spaced ridges or members. The bottom and the upstanding members define a slot or groove adapted to receive an electrical wire. The end of a wire such as an electric resistance heating element can be inserted into the slot. Then, using an orbital riveter to apply a plurality of spaced, angular blows to the ridges, the wire can be staked to the head by riveting the ridges so that material is forced over the wire in the slot.

2 Claims, 12 Drawing Figures

METHOD OF ELECTRICAL CONNECTOR

This is a division of application Ser. No. 863,481 filed Dec. 22, 1977, and now abandoned.

BACKGROUND OF THE INVENTION

This invention relates to electrical connectors, and more particularly to an improved head for such connectors and a method of securing a wire to the improved head.

Electrical connectors, as commonly constructed, include a head that can be connected to a first electrically conductive material such as a wire and a base that can be connected to a second electrically conductive material such as a second wire or a metal plate. There are a variety of uses for such connectors. For example, electrical connectors are often used in electric resistance heaters to connect a heating element to an outside source of electrical energy. Frequently, the head of an electrical connector has a generally semi-spherical shape with the surface of the top of the head defining a slot or groove. An electric wire can be mechanically bonded or secured to such a head by inserting one end of the wire into the slot and then tacking or staking the end of the wire to the head. The stacking process includes, typically, centering the head under a riveter and then hammering, or peening, the center top of the head in a downward direction. The hammering flattens the top of the head. That is, material at the very top of the head on either side of the slot is forced downward and is spread out. This causes the material to move over the wire in the slot. If a sufficient amount of material is moved over the wire, the wire becomes bound to the head and is prevented from moving from the slot. After the wire has been staked to the head, the electrical connection between the wire and the head can be improved by spot welding the wire to the head.

With the above described staking process, the hammering force is in a downward or vertical direction, while the material at the top of the head must move in a horizontal direction in order to move into the slot over the wire. This results in a relatively large peening force being needed to move a comparatively small amount of material over the wire. Also, since good results can be obtained if an approximately equal amount of material from either side of the slot is forced over the wire, it is desirable that the peening force be accurately directed so that it is distributed about equally to the material on either side of the slot.

The above described staking process has several disadvantages. First, because of the size and accuracy required of the peening force, it is difficult to obtain the correct force, and the proper force is not always applied. If the force is inadequate or not properly directed, then the wire may not be securely staked to the head and the wire may break away from the electrical connector. A weak stake also may cause a weak spot weld, and this results in poor electrical contact between the wire and the head. A second disadvantage is that only a relatively narrow range of sizes of wires can be staked to any one size of head. This is due to the fact that if the cross-section of the wire is considerably smaller than the cross-section of the slot, then a substantial amount of matter must be forced into the slot to prevent the wire from being removed from the slot. The size of the peening force needed to move this amount of matter may be so large that when applied it will actually break the head. Or, the force may be beyond the capability of the riveting machine.

SUMMARY OF THE INVENTION

An object of the present invention is to improve the mechanical bonding of wires to electrical connectors.

A further object of the present invention is to reduce the size and accuracy of the peening force required to stake a wire to a head of an electrical connector.

An additional object of the present invention is to provide a new method for staking a wire to an electrical connector.

A still another object of the present invention is to increase the reliability of electrical apparatus that utilize electrical connectors.

These and other objectives are attained with an electrical connector having a head that includes a bottom and two upstanding, parallel, spaced ridges or members. The bottom and the upstanding members define a slot or groove adapted to receive an electric wire. The end of a wire such as an electric resistance heating element can be inserted into the groove. Then, using an orbital riveter, the wire can be staked to the head by riveting the ridges so that material is forced over the wire in the groove. The head of the present invention, as opposed to a conventional head, has more material for movement. Also, by using an orbital riveter, which applies a plurality of spaced, angular blows to the upstanding members, less force is needed to move material over the wire. These factors result in a reduction of the size and accuracy of the peening force necessary to securely stake a wire to the head, and increase the range of wire sizes that can be staked to the head.

Further benefits and advantages of the invention will become apparent from a consideration of the following description given with reference to the accompanying drawings which specify and show a preferred embodiment of the invention.

A DETAILED DESCRIPTION OF A PREFERRED EMBODIMENT

Figure 1:
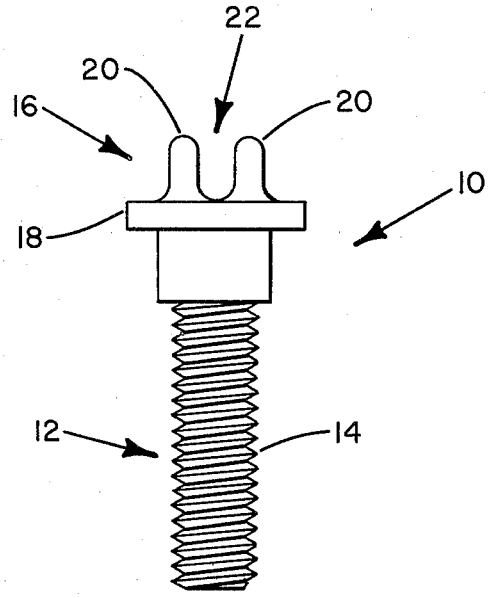
FIG. 1 is a front view of a bolt type electrical connector having a head constructed according to the present invention.
Figure 2:
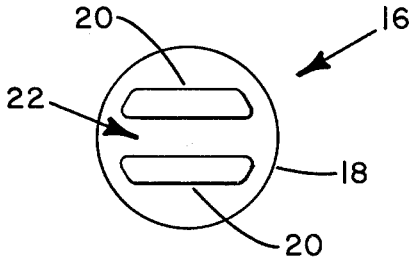
FIG. 2 is a top elevation view of the electrical connector shown in FIG. 1.

Referring to the drawings, and particularly to FIG. 1, there is illustrated an electrical connector generally designated as 10. The connector 10 is of the bolt type having a shaft 12. A portion of the shaft 12 is threaded, and the threaded portion is designated as 14. The connector 10 also includes a head 16 constructed according to the present invention. While a preferred embodiment of the invention is utilized with a carriage bolt type of electrical connector 10, it should be understood that the invention is applicable to electrical connectors generally. Referring to FIGS. 1 and 2, the head 16 of the electrical connector 10 includes a base 18 and two upstanding, parallel, spaced ridges or members 20. The ridges 20 and the base 18 define a groove or slot 22. To mechanically bond a wire to the head 16, the wire is inserted into the groove 22 and then, using an orbital riveter in the manner described below, the ridges are riveted over the wire.

Figure 3:
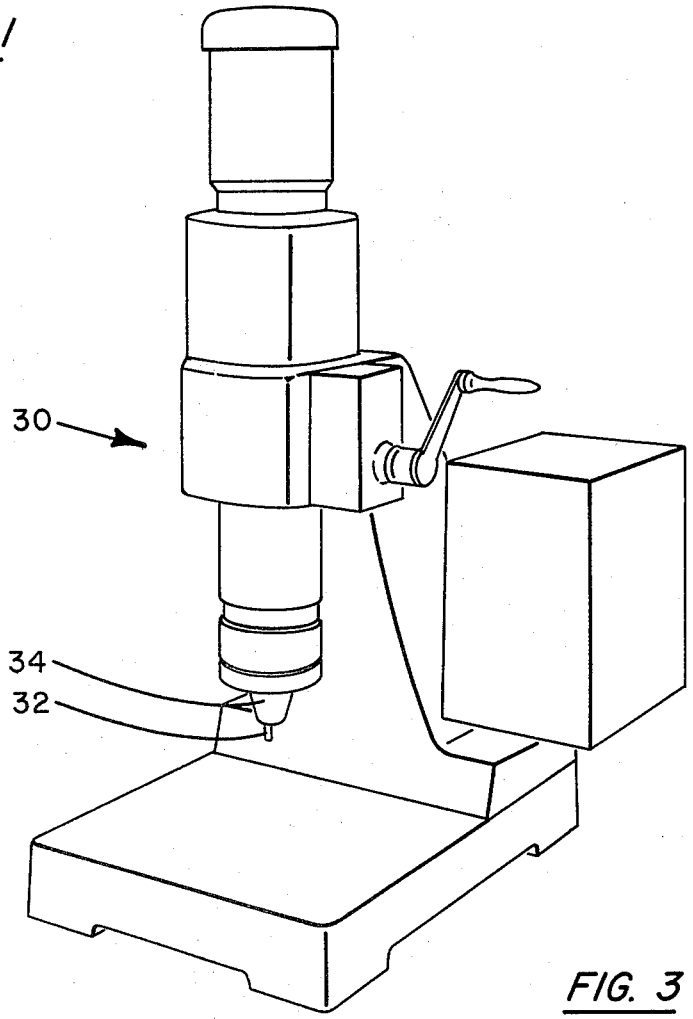
FIG. 3 is a front perspective view of an orbital riveter.

An orbital riveter 30 is depicted in FIG. 3. The riveter 30 includes peen 32 and a peen head 34. In operation, the peen 32 moves repeatedly upwards and downwards along its center line, applying a series of hammering forces to whatever is positioned below it. At the same time, the peen 32 moves relative to the peen head 34 in a rotational type of motion wherein the center line of the peen traces an imaginary conical surface. The apex of this imaginary conical surface is below the bottom of the peen 32. Thus, the peen 32 can strike a series of spaced, angled blows along the circumference of a circle with each blow directed toward the apex of the above described imaginary conical surface.

Figure 4:
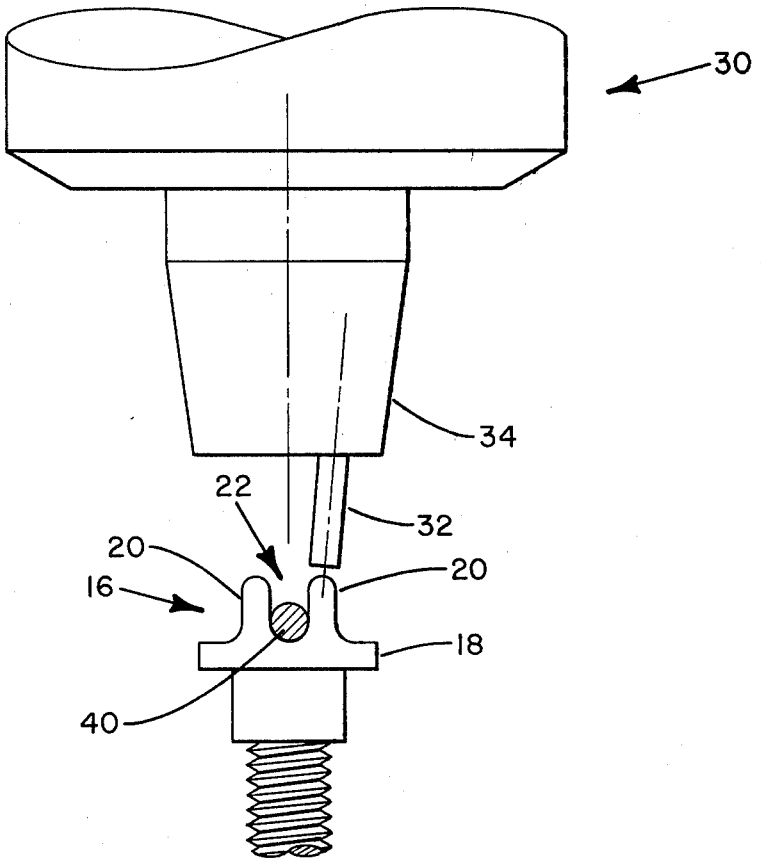
FIG. 4 is a front view showing a wire being staked to the head of the electrical connector shown in FIGS. 1 and 2 by means of an orbital riveting process.
Figure 5:
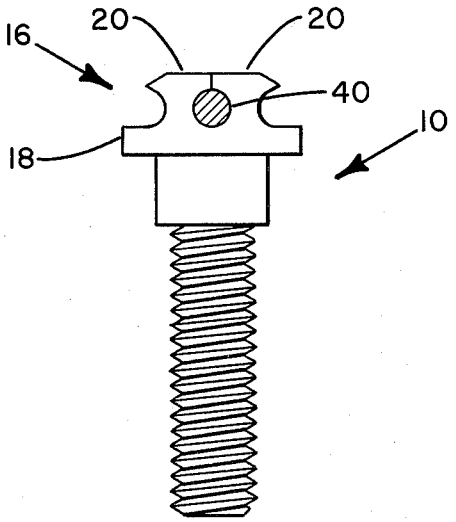
FIG. 5 is a front view of a wire staked to the electrical connector shown in FIGS. 1 and 2.
Figure 6:
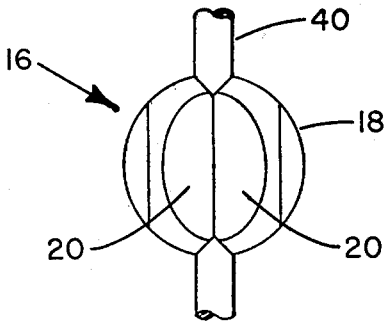
FIG. 6 is a top elevation view of the wire and electrical connector shown in FIG. 5.

Referring to FIG. 4, to stake a wire 40 to the head 16, the wire is inserted into the groove 22 and the head is centered below the peen head 34 of the orbital riveter 30. The riveter 30 is then activated so that the peen 32 moves around the upstanding members 20 and strikes a series of spaced blows around the upstanding members at an inwardly inclined angle to the centerline of the head 16. In this manner, the peen 32 hammers material into the groove 22 over the wire 40. The result of this hammering action is shown in FIGS. 5 and 6. The hammering action closes substantially the entire top of the groove 22 riveting the wire 42 to the head 16. The wire 42 becomes fastened to the head 16.

Figure 7:
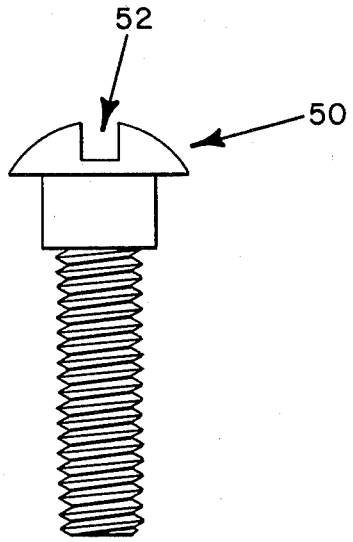
FIG. 7 PRIOR ART
FIG. 7 is a front view of a prior art bolt type electrical connector utilizing a conventional head.
Figure 8:
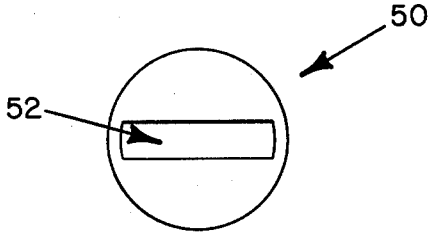
FIG. 8 PRIOR ART
FIG. 8 is a top elevation view of the electrical connector shown in FIG. 7.
Figure 9:
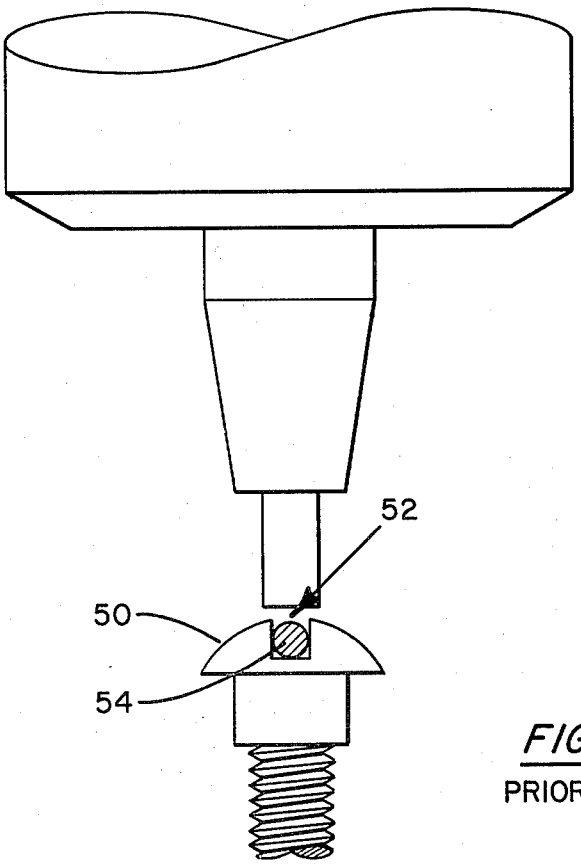
FIG. 9 PRIOR ART
FIG. 9 is a front view showing a wire being staked to the head of the electrical connector shown in FIGS. 7 and 8 by means of a conventional riveting process.
Figure 10:
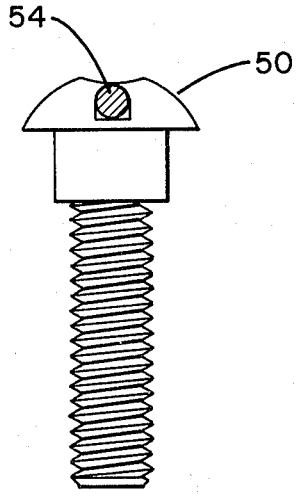
FIG. 10 PRIOR ART
FIG. 10 is a front view of a wire staked to the electrical connector shown in FIGS. 7 and 8.
Figure 11:
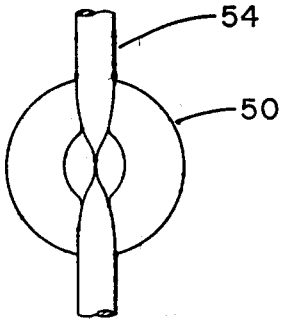
FIG. 11 PRIOR ART
FIG. 11 is a top elevation view of the wire and electrical connector shown in FIG. 10.

It is believed that the advantages of the present invention can be better understood by directly comparing the head 16 to a conventional head. A conventional head is shown in FIGS. 7 and 8, and the head is designated as 50. The head 50 has a semi-spherical shape with the surface of the top of the head defining a small notch or groove 52. Conventionally, as shown in FIG. 9, a wire 54 is staked to the head 50 by placing the wire in the groove 52 and hammering the center top of the head. The end result of this conventional process is shown in FIGS. 10 and 11. The hammering flattens the very top of the head 50, forcing material into the groove 52 over the wire 54.

There are a number of advantages of the present invention. First, as seen by comparing FIG. 4 with FIG. 9, with the present invention the direction of the peening force is more closely aligned with the movement of material into the slot 22. By more directly forcing material into the slot 22, the present invention does not need as great a peening force as previously required in order to move material into the slot. Second, by rotating the peening force around the upstanding members 20 and applying a plurality of hammering forces to each of the upstanding members, as opposed to applying a single hammering force which acts on material on both sides of the slot, the peening force need not be as accurately directed in order to move a roughly equal amount of material from both upstanding members into the slot 22.

A third advantage of the present invention is that the upstanding members 20 are shaped to provide more material for movement into the slot 22 and to facilitate the movement of material into the slot. According to the present invention, the inside faces of the upstanding members 20 are generally vertical and the width of the slot 22 is equal to or greater than the diameter of the largest wire that is to be secured to the head 16. Also, the inside perimeter of the slot 22, that is, referring to FIG. 1, the distance from the top of the inside face of the left upstanding member 20 down to the base 18, across the base to the inside face of the right upstanding member, and up to the top of the inside face of the right upstanding member, is substantially equal to or greater than the circumference of the largest wire which is to be staked to the head 16. With these dimensions, in contrast to the slot 52 of the conventional head 50, the slot 22 of the improved head 16 is larger and there is more material in the vicinity of the slot. Further, according to the present invention, throughout a substantial portion of the height of each upstanding member 22, the width of the upstanding member is less than the height of the upstanding member. By so limiting the width of the upstanding members 20, the amount of force necessary to deform the upstanding members in order to cover a wire 40 placed in the slot 22 is less than that which is required by the conventional head 50. By limiting the amount of force necessary to move material into the slot 22, movement of material into the slot is eased, and this further reduces the size of the peening force needed to stake the wire 40 to the head 16.

Furthermore, by providing more material for movement into the slot 22 and decreasing the size of the force needed to move material into the slot, the amount of material which can be moved into the slot is increased. Enough material can be moved into the slot 22 to close substantially the entire top of the slot, as best understood from FIG. 6. In comparison, with the conventional prior art head 50 and the conventional prior art staking process, only a relatively small portion of the top of the slot is closed, as best understood from FIG. 11. Moreover, a sufficient amount of material can be forced into the slot 22 to stake to the improved head 16 a wire which is too small to be staked to the conventional head 50. Thus, with the head 16 of the present invention, the range of wire sizes that can be staked to the head is increased.

While the above-described dimensions define the head of the present invention broadly, the head 16 shown in FIGS. 1 and 2 is constructed according to preferred dimensions. Referring to the head illustrated in FIGS. 1 and 2, the width of the slot 22 is equal to the diameter of the largest wire which will be used with the head 16, the height of each upstanding member 20 is approximately one and two-thirds the width of the slot, and the width of each upstanding member is approximately one-half the height of the upstanding member. In addition, in a preferred embodiment, the outside faces of the upstanding members 20 are generally vertical and parallel to the inside faces of the upstanding members. Also, the upstanding members, as best understood from FIG. 2, extend across substantially the entire base 18. Furthermore, in a preferred embodiment of the present invention, the lower portion of the slot 22 is rounded, as seen in FIGS. 1 and 4. This is in comparison to the square-corner shape of the lower portion of the slot 52 of the conventional head 50, as seen in FIGS. 7 and 9. By rounding the lower portion of the slot 22, a closer, tighter fit between the slot and the wire 40 is provided. This, in turn, provides for a more secure mechanical bond between the wire 40 and the improved head 16. The above described dimensions and features are preferred because, as shown by FIGS. 5 and 6, they produce excellent results.

Figure 12:
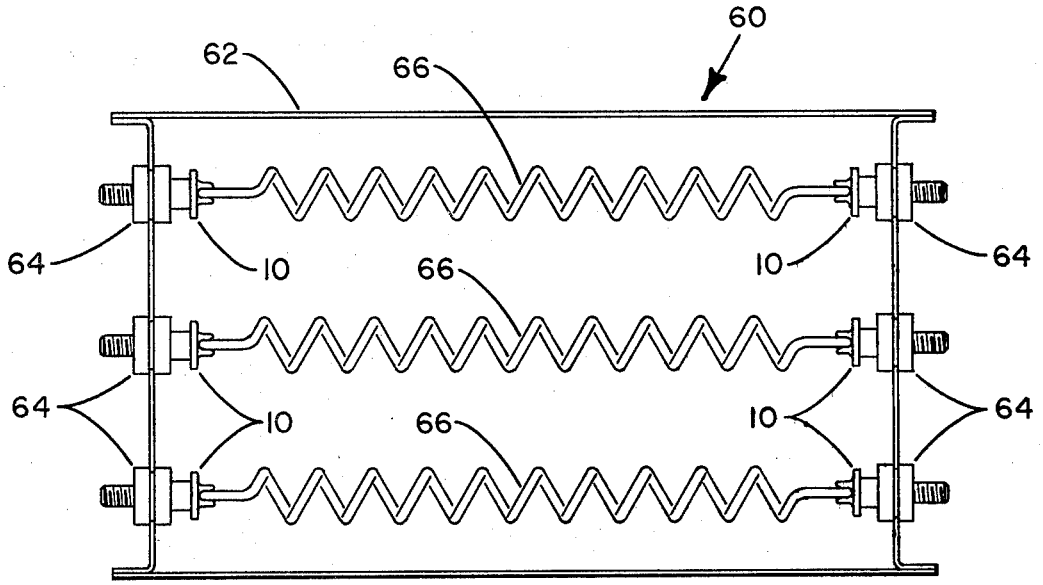
FIG. 12 is a front view of an electric resistance heater utilizing electrical connectors of the type shown in FIGS. 1 and 2.

FIG. 12 shows an electric resistance heater 60 utilizing the present invention in a typical manner. The heater 60 includes a frame 62, a plurality of insulators 64 that extend through and are supported by the sides of the frame, and a plurality of electrical connectors 10 that extend through and are supported by the insulators. The insulators 64 are positioned so that two insulators are directly opposite each other, and a helical coil of electric resistance wire 66 extends transverse of the frame 62 between pairs of insulators. Each end of a helical coil 66 is staked to one end of an electrical connector 10 in the manner described above. After the coil is staked to the connector 10, the electrical connection between the two is improved by spot welding the coil to the head 16. The other end of the connector 10 extends through an insulator 64 and the frame 62 for connection to an outside source of electrical energy. The peening force necessary to stake the wire 66 to the connector 10, for the reasons discussed above, need not be as large nor as accurate as previously required. Thus, it is easier to obtain the correct force, and the proper force will be applied in a much larger percentage of cases. This significantly increases the reliability of electrical connectors 10 by substantially improving the odds that the wire 66 will be securely staked to the connector. This, in turn, improves the reliability of electrical apparatus such as the electrical heater 60 which utilize electrical connectors 10.

While it is apparent that the invention herein disclosed is well calculated to fulfill the objects above stated, it will be appreciated that numerous modifications and embodiment may be devised by those skilled in the art and it is intended that the appended claims cover all such modifications and embodiments as fall within the true spirit and scope of the present invention.

I claim:

1. A method of securing a wire to a head of an electrical connector, the head including a base and a pair of spaced members extending upwards from the base, the method including the steps of:

placing the wire in a groove defined by the base and the upwardly extending members;

applying a plurality of hammering forces directly to the upwardly extending members, the direction of the hammering forces forming an acute angle with a vertical plane generally bisecting the groove for deforming the upwardly extending members to substantially cover the wire in the groove; and moving the direction of the hammering forces around the upwardly extending members while maintaining an acute angle between the direction of the hammering forces and the vertical plane generally bisecting the groove to apply a plurality of hammering blows spaced around the periphery of the upwardly extending members to force material over the wire.

2. A method according to claim 1 wherein the force applying step includes the steps of:

positioning the head below an orbital riveter, and activating the riveter to apply a series of spaced blows around the upwardly extending members to rivet the members over the wire in the slot.

* * * * *